US006311709B1

(12) United States Patent
Louie et al.

(10) Patent No.: US 6,311,709 B1
(45) Date of Patent: Nov. 6, 2001

(54) SELF-ERECTING, COLLAPSIBLE AND FOLDABLE DOME STRUCTURE

(75) Inventors: Wai Hang Louie, Kowloon; Ming Tak Yau, Shing, both of (HK)

(73) Assignee: Billwin Auto Accessories, Ltd. (HK)

( * ) Notice: Subject to any disclaimer, the term of this patent is extended or adjusted under 35 U.S.C. 154(b) by 0 days.

(21) Appl. No.: 09/470,721

(22) Filed: Dec. 23, 1999

(51) Int. Cl.[7] ..... Z04H 15/44

(52) U.S. Cl. ..... 135/125; 135/128; 135/136; 135/137; 135/115; 135/905; 446/478

(58) Field of Search ..... 135/124–126, 135/128, 115, 95, 97, 905, 906, 136, 137; 446/478, 487; D21/834–840

(56) References Cited

U.S. PATENT DOCUMENTS

| | | | | |
|---|---|---|---|---|
| 3,699,986 | * | 10/1972 | Kirkham | 135/116 X |
| 3,990,463 | | 11/1976 | Norman | 135/4 R |
| 4,825,892 | | 5/1989 | Norman | 135/104 |
| 4,858,634 | * | 8/1989 | McLeese | 135/125 |
| 5,038,812 | * | 8/1991 | Norman | 135/125 |
| 5,159,948 | * | 11/1992 | Moreau et al. | 135/125 |
| 5,163,461 | * | 11/1992 | Ivanovich et al. | 135/126 |
| 5,301,705 | * | 4/1994 | Zheng | 135/125 |
| 5,396,917 | * | 3/1995 | Hazinski et al. | 135/125 |
| 5,676,168 | | 10/1997 | Price | 135/126 |
| 5,816,278 | | 10/1998 | Kim | 135/126 |
| 6,098,349 | * | 8/2000 | Zheng | 52/126 |
| 6,109,282 | * | 8/2000 | Yoon | 135/126 |

* cited by examiner

*Primary Examiner*—Winnie S. Yip
(74) *Attorney, Agent, or Firm*—Henri J. A. Charmasson; John D. Buchaca

(57) ABSTRACT

A self-erecting, collapsible and foldable dome structure comprises an armature formed by two unconnected loops of resiliently flexible wire concentrically and orthogonally intersecting at the center of the structure, and being bent into a dome shaped configuration. The fabric cover comprises two commensurate cruciform sheets joined around their peripheries to form an envelope containing the armature, and a series of gore panels filing the gaps between the arms of the cruciform envelope.

15 Claims, 2 Drawing Sheets

SELF-ERECTING, COLLAPSIBLE AND FOLDABLE DOME STRUCTURE

FIELD OF THE INVENTION

This invention relates to tents and other light, temporary structures made of canvas stretched over a collapsible armature.

BACKGROUND OF THE INVENTION

There is disclosed in the prior art several types of self-erecting tents and similar structures which rely on springy armatures made of wire loops to instantaneously deploy the devices. Some of those simplest structures, such as the ones disclosed in U.S. Pat. No. 4,825,892 Norman, are very unstable and require the use of ground spikes or other securing devices.

More stable, but also more complex self-erecting tents, such as those disclosed in U.S. Pat. No. 5,163,461 Ivanovich et al., use long lengths of steel wire to form numerous loops, adding considerable weight to a device which is intended to be easily carried.

U.S. Pat. No. 5,038,812 and 5,301,705 disclose other self-erecting tents that requires interconnecting six separate panels to form a dome-shaped enclosed space.

The instant invention results from an attempt to reduce the amount of panels and armature material without compromising the volume and stability of a dome-shaped tent structure, and to improve the structure foldability by reducing the number of wire loop panels.

SUMMARY OF THE INVENTION

The principal and secondary object of this invention are to provide a simple self-erecting and easily collapsible dome-shaped tent structure that combines stability and light weight. These and other valuable objects are achieve in a basic model by using only two unconnected wire loops to form the armature of the structure. The fabric cover comprises two cruciform capping pieces peripherally sewn together for form an envelope that contains and constrains the two loops into a quasihemispherical shape. Gore segments are used to bridge the gaps between the arms of the capping piece. The corners of a quadrangular floor mat is attached to the distal ends of the cruciform capping piece, while its sides are connected to the bases of the gore segments. Alternately, a circular floor mat may be used to achieve a near-perfect hemispherical shape.

DESCRIPTION OF THE PREFERRED EMBODIMENT OF THE INVENTION

Figure 1:
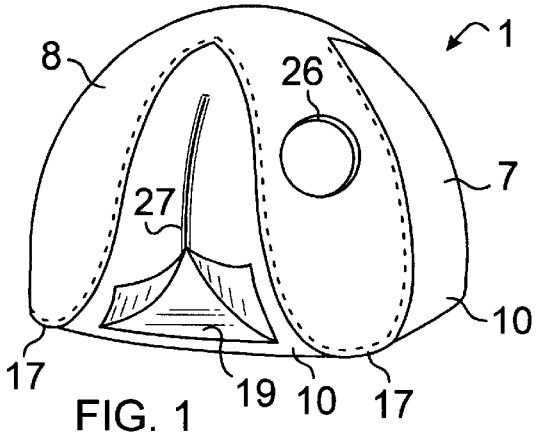
FIG. 1 is a perspective view of a self-erecting, collapsible and foldable dome structure according to the invention.
Figure 3:
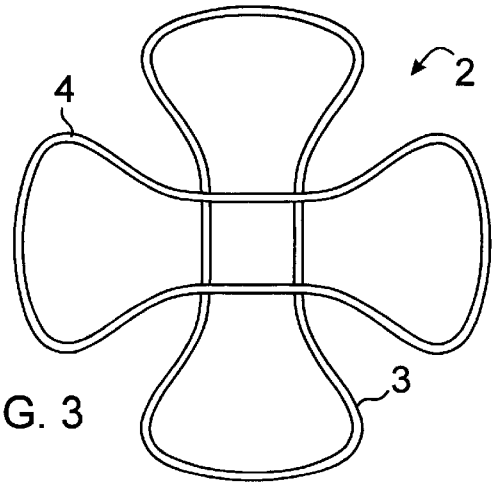
FIG. 3 is a top plan view of the armature.
Figure 2:
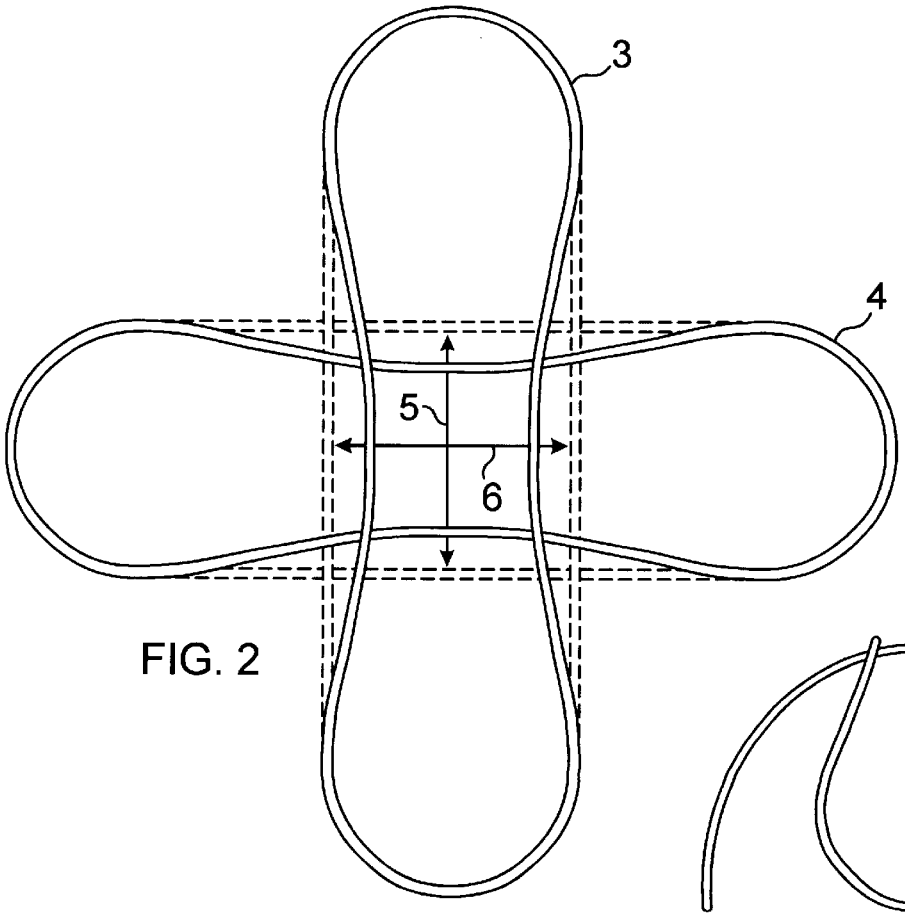
FIG. 2 is a top plan view of the unbent wire frames forming the armature of the structure.
Figure 4:
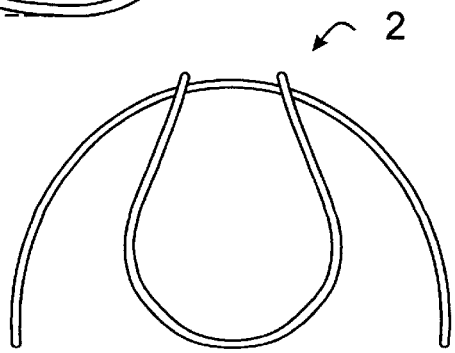
FIG. 4 is a side elevational view thereof.

Referring now to the drawing, there is shown in FIG. 1, a self-erecting, collapsible and foldable tent structure 1 shown in the fully erected state. Said structure comprises an armature 2 more specifically illustrated in FIGS. 2–4. That armature comprises two loop frames 3, 4 made from a steel wire or any pliable resiliently flexible filiform element. The two frames are concentrically superimposed upon each other, but not interconnected, and more specifically, are intersecting each other orthogonally in the cruciform arrangement illustrated in FIG. 2. The frames are also forcibly bent about their short axis 5, 6 into the dome-like configuration illustrated in FIGS. 3 and 4. Each frame is untwisted so that no part of it crosses over any other part.

Figure 5:
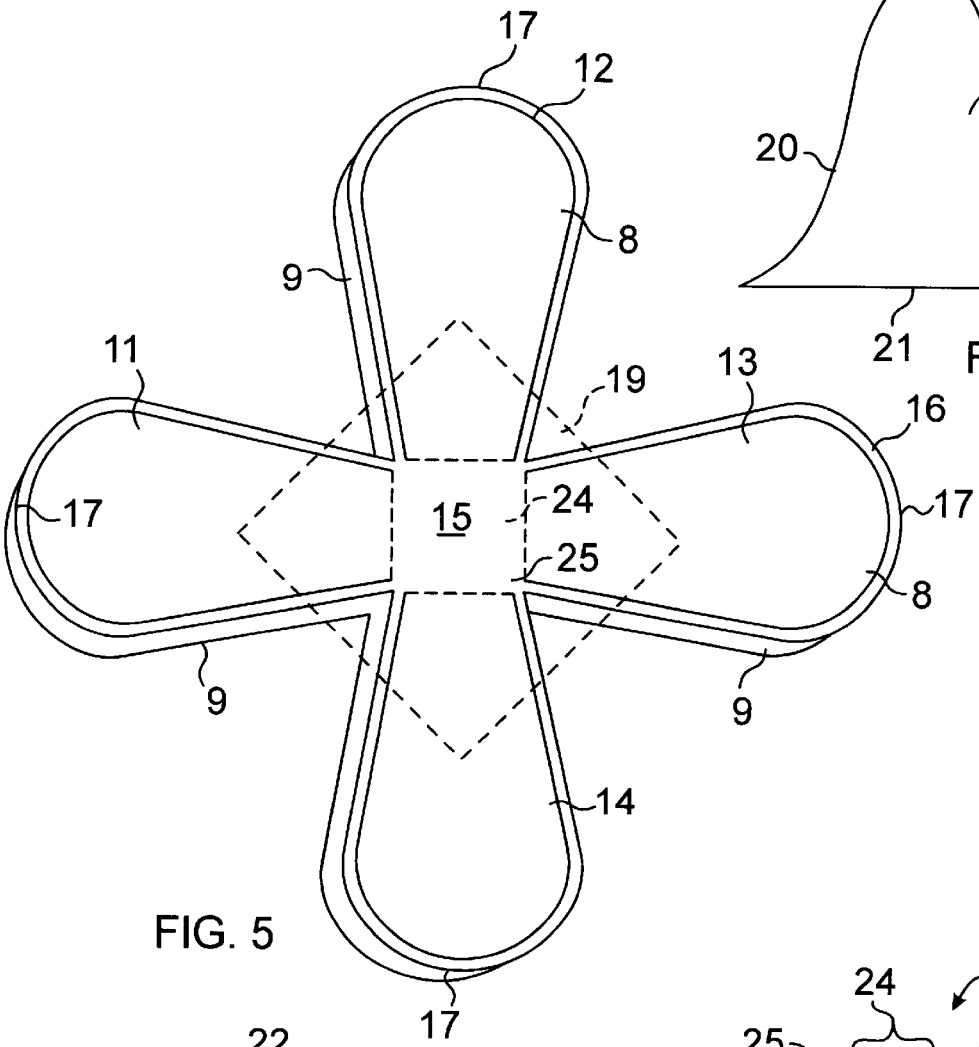
FIG. 5 is a top plan view of the first and second cruciform cover sheets.
Figure 6:
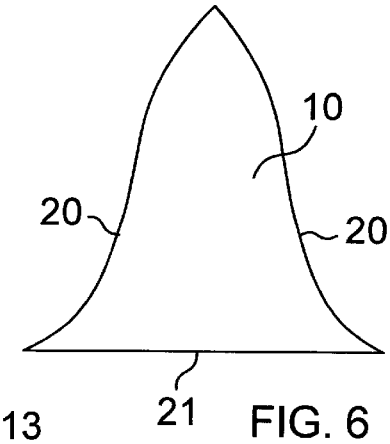
FIG. 6 is a top plan view of a gore segment.
Figure 8:
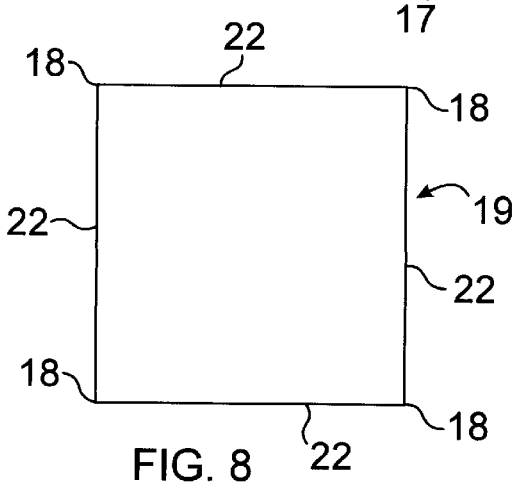
FIG. 8 is a top plan view of the floor mat.

The armature 2 supports, and is constrained in its dome-like configuration by a covering 7 made of pliable, fabric-like material such as canvas, woven or unwoven synthetic fabric or film. The covering 7 comprises two superimposed and peripherally joined cruciform sheets 8 and 9 as illustrated in FIG. 5, and four gore segments 10 as shown in FIG. 6. Each of the four arms 11, 12, 13 and 14 of each cruciform sheet has a variable width that tapers down toward the quadrangular central zone 15. A peripheral marginal channel 16 formed by stitching and surrounding the edges of each arm is engaged by a portion of one of the frames 3, 4. It should be noted that the frames intersect one another within the central zone 15 which is devoid of any stitching. In other words, the two cruciform sheets form an envelope which contains the loop frames 3, 4. The most distal points 17 of the arms are joined to the four corners 18 of a quadrangular floor mat 19 shown in FIG. 8, and the gore segments 10 are joined along their sides 20 to the sides of two adjacent arms, and along their base lines 21 to the side 22 of the floor mat 19. The cruciform sheets, gore segments and floor mat form a unitary housing structure supported by the deployed armature that can rest on a ground surface in the absence of any stake or other anchoring device.

Figure 7:
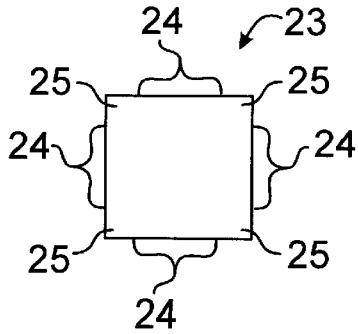
FIG. 7 is a top plan view of the alternate second cover sheet.

A small quadrangular sheet 23 as shown in FIG. 7 can be substituted for the second cruciform sheet 9. That quadrangular sheet is commensurate with the central zone 15 of the cruciform sheet 8 and is joined to it along side sections 24 leaving unjoined the corner section 25 to provide passageways for the frames.

One or more window openings 26 can be provided within either one of the arms as illustrated in FIG. 1 or into one of the door panels 10. An access opening 27 sealable by means of a slide fastener or cloth fastener can also be provided in one of the door panels 10 as illustrated in FIG. 1 or alternately in one of the arms.

The structure can be conveniently folded by grabbing the distal ends of two opposite arms and twisting those arms 180 degrees apart. This tends to bring the four arms vertically against the one another to form a flat package.

While the preferred embodiment of the invention has been described, modifications can be made and other embodiments may be devised without departing from the spirit of the invention and the scope of the appended claims.

What is claimed is:

1. A self-erecting, collapsible and foldable structure which comprises:

an armature including two unconnected loop frames made of resiliently flexible filiform material, each of said loop frames having a major axis and minor axis;

said loop frames being concentrically and orthogonally intersecting, and being bent downwardly about their respective minor axes into a dome-shaped configuration; and a covering made of fabric material commensurate with said dome-shaped configuration, spread over said armature.

2. The structure of claim 1, wherein said covering comprises:

a first cruciform sheet including a central zone and four arms, each of said arms having a distal end; and a plurality of gore segments, each of said segments having a bottom edge, and being interposed between, and joined to, two of said arms.

3. The structure of claim 2, wherein said covering further comprises a second cruciform sheet having four arms commensurate with, and being peripherally joined to, the arms of said first sheet to define an envelope containing said armature.

4. The structure of claim 3, wherein each of said arms has a width tapering down toward the central zone of said cruciform sheets.

5. The structure of claim 4, wherein said loop frames cross over one another about said central zone; and each of said arms has a peripheral, marginal channel engaged by a vertical section of each of said loop frames.

6. The structure of claim 3, which further comprises a floor mat peripherally joined to the distal ends of said arms and the bottom edges of said gore segments.

7. The structure of claim 6, wherein said floor mat is quadrangular.

8. The structure of claim 3, having at least one access opening cut into one of said arms.

9. The structure of claim 3, having at least one access opening cut into one of said gore segments.

10. The structure of claim 2, wherein said covering comprises:

a sheet commensurate with and being peripherally joined to the central zone of said first sheet to define an envelope containing intersecting central portions of said loop frames.

11. The structure of claim 10, wherein each of said arms has a width tapering down toward the central zone of said first cruciform sheet.

12. The structure of claim 11, wherein said loop frames cross over one another about said central zone; and each of said arms has a peripheral, marginal channel engaged by a vertical section of each of said loop frames.

13. The structure of claim 10, which further comprises a floor mat peripherally joined to the distal ends of said arms and the bottom edges of said gore segments.

14. The structure of claim 10, wherein said cover has at least one access opening cut into one of said arms.

15. The structure of claim 10, wherein said covering has at least one access opening cut into one of said gore segments.

* * * * *